US008070552B2

(12) United States Patent
Snyder

(10) Patent No.: US 8,070,552 B2
(45) Date of Patent: Dec. 6, 2011

(54) REPOSITIONABLE INFANT ENTERTAINMENT DEVICE

(75) Inventor: Carol Snyder, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 165 days.

(21) Appl. No.: 12/568,178

(22) Filed: Sep. 28, 2009

(65) Prior Publication Data

US 2011/0076912 A1 Mar. 31, 2011

(51) Int. Cl.
*A63H 33/42* (2006.01)
*A63H 33/00* (2006.01)

(52) U.S. Cl. ..... 446/227; 446/268

(58) Field of Classification Search ..... 446/7, 29, 446/71, 175, 214, 227, 268; 482/35; 5/655
See application file for complete search history.

(56) References Cited

U.S. PATENT DOCUMENTS

| | | | | |
|---|---|---|---|---|
| 596,207 | A | 12/1897 | Hart | |
| 2,437,241 | A | 3/1948 | Burlin | |
| 3,999,731 | A | 12/1976 | Filip | |
| 4,627,588 | A | 12/1986 | Block | |
| 4,974,802 | A | 12/1990 | Hendren | |
| 5,494,333 | A | 2/1996 | Wilson | |
| 5,628,689 | A | 5/1997 | Saint et al. | |
| 6,296,415 | B1 | 10/2001 | Johnson et al. | |
| 6,702,643 | B1 * | 3/2004 | Drosendahl et al. | 446/227 |
| 7,037,170 | B2 * | 5/2006 | Pacella et al. | 446/268 |
| 7,153,181 | B2 | 12/2006 | Cheng et al. | |
| 7,316,993 | B2 * | 1/2008 | Anderson | 510/205 |
| 7,775,944 | B1 | 8/2010 | Shultz | |
| 2005/0172411 | A1 | 8/2005 | Snedeker | |
| 2006/0037274 | A1 | 2/2006 | Perez et al. | |
| 2008/0182477 | A1 | 7/2008 | Catelli | |

FOREIGN PATENT DOCUMENTS

| | | | |
|---|---|---|---|
| JP | 10192101 | A | 7/1998 |
| JP | 2000-237462 | A | 9/2000 |
| JP | 2005342365 | A | 12/2005 |
| KR | 20-0209541 | Y1 | 4/2001 |

OTHER PUBLICATIONS

ISR from related PCT/US2010/049679 (WO2011037928), Apr. 28, 2011.

* cited by examiner

*Primary Examiner* — Kien Nguyen
(74) *Attorney, Agent, or Firm* — Edell, Shapiro & Finnan, LLC

(57) ABSTRACT

An infant gym includes a first support member having opposite ends engageable with a support surface, a hub located between the ends of the first support member, and a second support member having a first end pivotally coupled to a rear portion of the hub and a second end engageable with the support surface. The second end of the second support member is movable toward and away from the ends of the first support member, thereby changing the orientation of the hub relative to the support surface.

20 Claims, 11 Drawing Sheets

"C"

REPOSITIONABLE INFANT ENTERTAINMENT DEVICE

FIELD OF THE INVENTION

The present invention relates to a repositionable infant entertainment device or gym. In particular, the present invention relates to an infant entertainment device with at least one support member that is adjustable by a user to change the configuration of the infant entertainment device and the orientation of the device relative to a child.

BACKGROUND OF THE INVENTION

Various infant entertainment devices are known in the art. Some devices include a frame assembly that is connectable to a mat. The frame assembly may include two arched members that span between diagonally opposing corners of the mat. Toys are coupled to the arched members and provide sensory stimuli for an infant lying on the mat. As the infant grows, it is desirable to provide an entertainment device that provides sensory stimulation configured for engaging a child disposed in a sitting position. There is a need for an infant gym having an entertainment component with a selectively adjustable orientation and providing enhanced sensory stimulation for the infant.

SUMMARY OF THE INVENTION

The present invention relates to an infant gym including a hub having opposing front and rear portions and opposing first and second sides. A first leg extends outwardly from the first side and has a distal end engageable with a support surface. A second leg extends outwardly from the second side and has a distal end engageable with the support surface. A third leg extends outwardly from the rear portion, and includes a first end pivotally coupled to the hub and an opposite second end engageable with the support surface. The first and second legs are fixedly coupled to the hub. The second end of the third leg is movable toward and away from the hub upon movement of the first end of the third leg relative to the hub. Such movement results in a change in the orientation of an entertainment component coupled to the front portion of the hub.

In one embodiment, the front portion of the hub is disposed at a first orientation relative to the support surface when the third leg is in a first position and a second orientation relative to the support surface when the third leg is in a second position different from the first position. In one embodiment, the infant gym includes a lock mechanism coupled to the third leg, which releasably retains the third leg in at least the first position and the second position.

In one embodiment, the third leg is substantially perpendicular to the first and second legs. Each of the legs may have a substantially arcuate configuration. In one embodiment, each of the legs includes a support member pivotally coupled to the corresponding distal end. In one embodiment, the support member includes a surface engaging portion that is adjustable relative to its corresponding leg.

The present invention also relates to an infant gym including a first support member having first and second opposite ends engageable with a support surface, a hub located between the ends of the first support member, and a second support member having a first end pivotally coupled to a rear portion of the hub and a second end engageable with the support surface. The second end of the second support member is movable toward and away from the ends of the first support member, thereby changing the orientation of the first support member relative to the support surface.

In one embodiment, the front portion of the hub is disposed at a first orientation relative to the support surface when the second support member is in a first position, and the front portion of the hub is disposed at a second orientation relative to the support surface when the second support member is in a second position different from the first position. In one embodiment, the infant gym includes a lock mechanism coupled to the second support member, which releasably retains the second support member in a selected orientation relative to the support surface.

In one embodiment, the second support member is substantially perpendicular to the first support member. The first support member may have a substantially U-shaped configuration. The hub may be fixedly connected to the first support member.

The present invention also relates to an infant entertainment device including an entertainment component. A first leg extends outwardly from a first side of the entertainment component, a second leg extends outwardly from a second side of the entertainment component, and a third leg extends outwardly from the entertainment component. The third leg is pivotally movable between a first position and a second position relative to the entertainment component. The entertainment component is disposed at a first angular orientation relative to a support surface when the third leg is in its first position and at a second angular orientation relative to the support surface when the third leg is in its second position, the second angular orientation being different than the first angular orientation.

In one embodiment, each of the legs includes a pivotally coupled surface engaging portion coupled of a distal end thereof. Each surface engaging portion is adjustable relative to its corresponding leg. The infant entertainment device may also include a lock mechanism coupled to the third leg, which releasably retains the third leg in a selected position between its first position and its second position. In one embodiment, the entertainment component is fixedly connected to the first and second legs.

BRIEF DESCRIPTION OF THE DRAWINGS

Like reference numerals have been used to identify like elements throughout this disclosure.

DETAILED DESCRIPTION OF THE INVENTION

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

The terms "infant entertainment device" and "infant gym" may be used interchangeably herein to refer to a structure that can be used to entertainment, amuse, and/or attract the interest of an infant or child. In some embodiments, an infant entertainment device may include an electronic system and generate various outputs, such as lights and sounds. In some embodiments, the infant entertainment device may be activated by an input from a child, whether an audible input or a tactile input. In other embodiments, the infant entertainment device may be passive and not include any electronics. The terms "leg," "support," and "support member" may be used interchangeably herein to refer to a component that provide support to another object or component.

Figure 1:
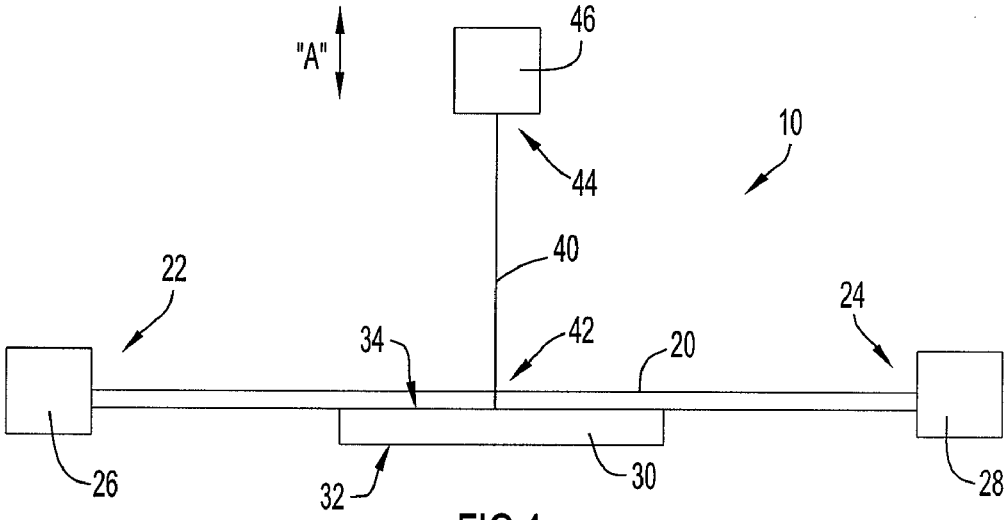
FIG. 1 illustrates a toy view schematic diagram of an embodiment of an infant entertainment device according to the present invention.
Figure 2:
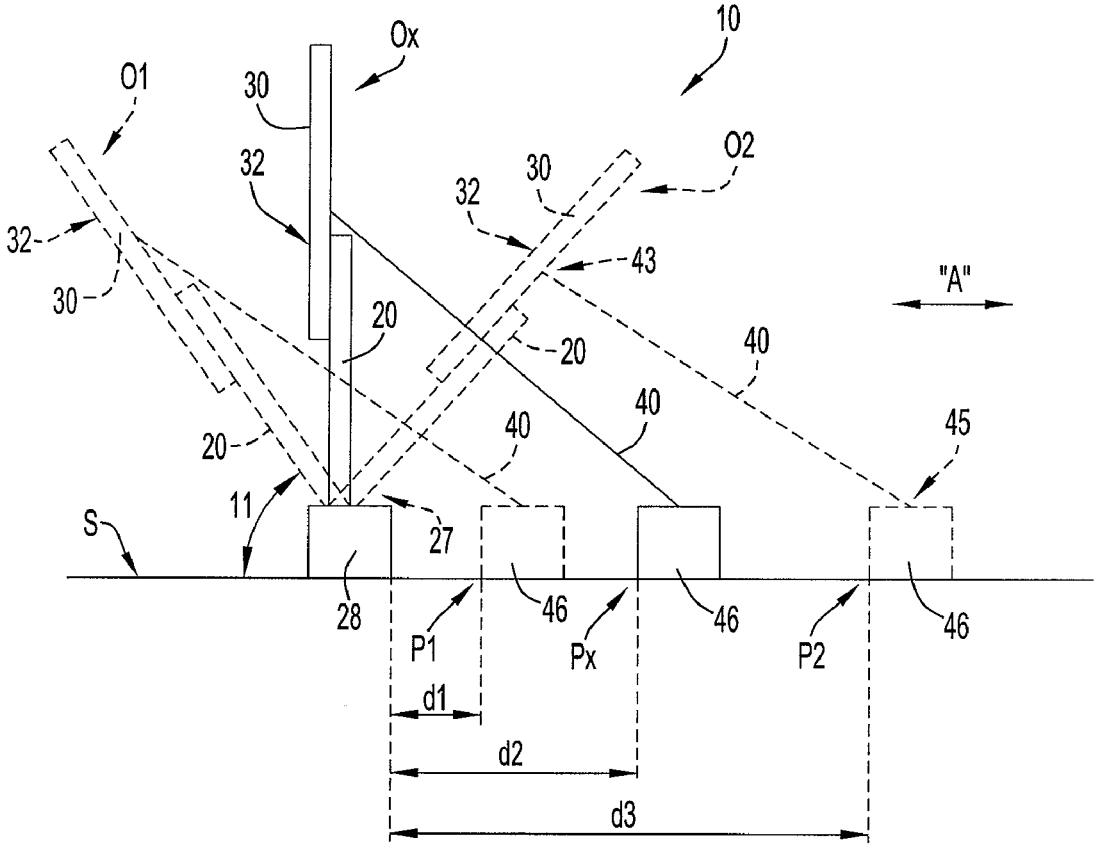
FIG. 2 illustrates a side view schematic diagram of the infant entertainment device illustrated in FIG. 1 in different configurations.

FIGS. 1 and 2 illustrate schematic diagrams of an infant entertainment device 10 according to an embodiment of the present invention. FIG. 1 is a top view of the infant entertainment device 10 and FIG. 2 is a side view of the infant entertainment device 10 in different configurations. The infant entertainment device 10 is repositionable or reconfigurable and is selectively disposable in different configurations relative to a support surface.

The infant entertainment device 10 includes a first support member 20, a hub 30 coupled to the first support member 20, and a second support member 40 coupled to the hub 30. The first support member 20 has a first end 22 and an opposite second end 24, which are engageable with a support surface S. In one embodiment, the first end 22 includes a pivotally coupled surface engaging portion 26 coupled thereto, and the second end 24 includes a pivotally coupled surface engaging portion 28 coupled thereto. Each of the surface engaging portions 26 and 28 is configured to be placed into contact with a support surface S. In one embodiment, the support member 20 is a single continuous member. In an alternative embodiment, the support member 20 is formed of two members that are coupled together.

The hub 30 is located between the first and second ends 22 and 24 of support member 20. In one embodiment, the hub 30 is fixedly connected to the first support member 20. The hub 30 includes a front portion 32 and an opposing rear portion 34. The second support member 40 has a first end 42 and an opposite second end 44. The first end 42 of the second support member 40 is pivotally coupled to the rear portion 34 of the hub 30. The second end 44 of the second support member 40 includes a pivotally coupled surface engaging portion 46 coupled thereto. The second support member 40 extends substantially perpendicularly relative to the first support member 20 as viewed from above.

Referring to FIG. 2, the surface engaging portion 46 of the second end 44 of the second support member 40 is engageable with the support surface S. The surface engaging portion 46 is movable toward and away from the surface engaging portions 26 and 28 of the first and second ends 22 and 24 of the first support member 20. As a result, movement of the surface engaging portion 46 changes the configuration of the infant entertainment device 10 and the orientation of the first support member 20 and the hub 30 relative to the support surface S.

Referring to FIG. 2, various configurations of the infant entertainment device 10 are illustrated. As discussed below, the movement of certain components of the device 10 and the relative spacing between components determines the particular orientation of parts of the device 10 and the configuration of the device 10. In particular, as certain components are moved closer to each other, the hub 30 inclines toward a child located in front of the device 10. As those components are moved away from each other, the hub 30 moves away from the child and is placed in an inclined position relative to the child.

The front portion 32 of the hub 30 is disposed at a first orientation O1 (shown in phantom) relative to the support surface S when the second support member 40 is in a first position P1. In position P1, the surface engaging portion 46 is spaced from portion 28 by a distance d1. Support member 20 is oriented at an angle 11 relative to the support surface S.

The surface engaging portion 46 is movable along the directions of arrow "A" in FIG. 2 relative to the support surface S. The support member 20 is pivotally coupled at connection 27 to support engaging portion 28. Similarly, support member 40 is pivotally coupled at connection 45 to support engaging portion 46 and at connection 43 to hub 30. Thus, as support engaging portion 46 moves away from support engaging portion 28, the pivoting connections 27, 43, and 45 allow for the repositioning of the support members 20 and 40.

Referring to FIG. 2, the front portion 32 of the hub 30 is disposed at a second orientation O2 (shown in phantom) relative to the support surface S when the second support member 40 is in a second position P2 different from the first position P1. When the infant entertainment device 10 is in this configuration, the angle 11 between the support surface S and the support member 20 is larger than when the infant entertainment device 10 is in its configuration corresponding to orientation O1. The distance "d3" between portions 28 and 46 is larger, thereby resulting in the angle between the support members 20 and 40 increasing.

The hub 30 is disposed at an orientation Ox intermediate to orientations O1 and O2 when the second support member 40 is in a position Px that is intermediate positions P1 and P2. In this configuration, the magnitude of angle 11 is between the magnitudes of the angles 11 corresponding to orientations O1 and O2. The distance "d2" between portions 28 and 46 is an intermediate distance, thereby resulting in the angle between the support members 20 and 40 being intermediate to the angles for the previously described configurations.

Thus, the angular orientation of the front portion 32 of the hub 30 relative to the support surface S may be adjusted by moving the surface engaging portion 46 of the second support member 40 relative to support engaging portion 28 and the first support member 20. The range of adjustability of the support engaging portion 46 is limited by the length and range of motion of the support members 20 and 40. The repositioning of the hub 30 is desirable to position the hub 30 so that it can be viewed easily by infants of varying sizes. In addition, the repositioning of the hub 30 enables sitting, kneeling, and standing infants to be able to access and engage the hub 30 of the device 10.

Figure 3:
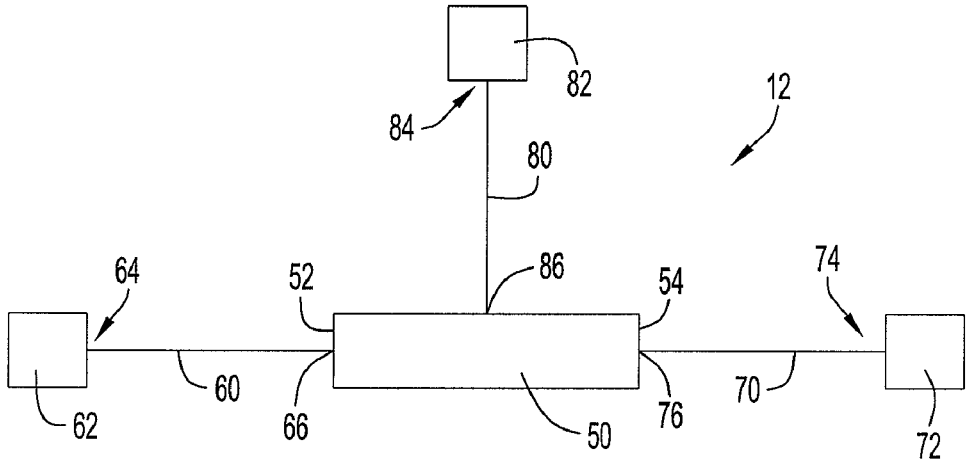
FIG. 3 illustrates a toy view schematic diagram of an alternative embodiment of an infant entertainment device.
Figure 4:
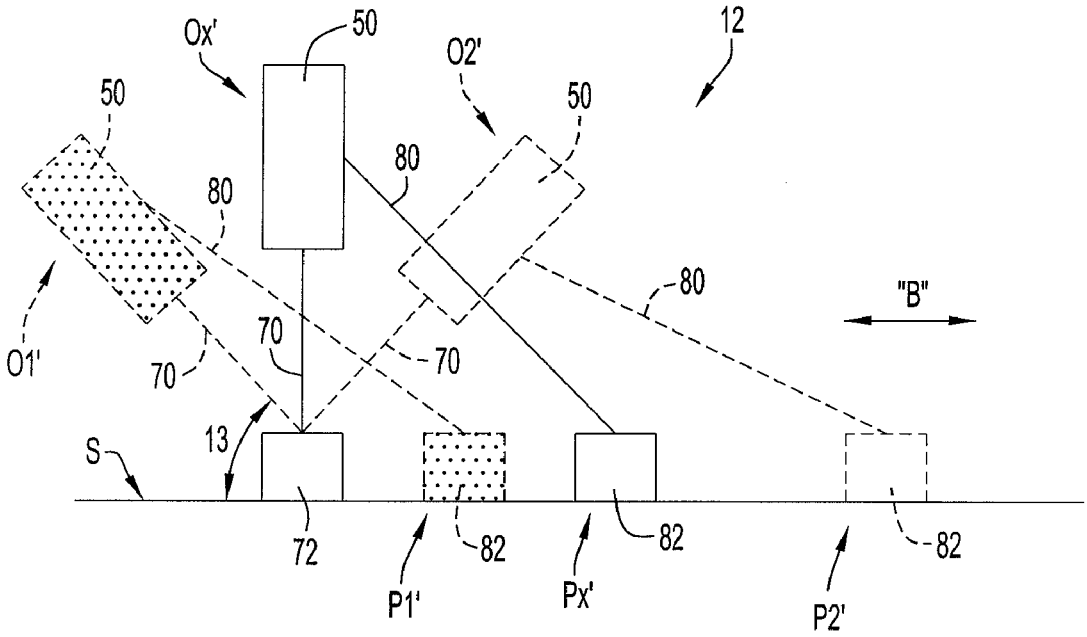
FIG. 4 illustrates a side view schematic diagram of the infant entertainment device illustrated in FIG. 3 in different configurations.

FIGS. 3 and 4 illustrate top and side view schematic diagrams of another embodiment of an infant entertainment device 12. Infant entertainment device 12 includes an entertainment component 50 including a first side 52 and a second side 54 opposite to the first side 52. A first leg 60 extends outwardly from the first side 52 of the entertainment component 50, and a second leg 70 extends outwardly from the second side 54 of the entertainment component 50. In one embodiment, the legs 60 and 70 are fixedly connected to the entertainment component 50. Another leg 80 extends outwardly from the entertainment component 50 intermediate the first leg 60 and the second leg 70. While component 50 is referred to as an entertainment component, in different embodiments, component 50 does not necessarily have entertainment features or functionality, which could be active or passive features.

The first leg 60 includes a surface engaging portion 62 at a distal end 64 thereof. Similarly, the second leg 70 includes a surface engaging portion 72 at a distal end 74 thereof, and the third leg 80 includes a surface engaging portion 82 at a distal end 84 thereof. In one embodiment, each of the surface engaging portions 62, 72, and 82 is pivotally coupled to its corresponding distal end 64, 74, 84, and is adjustable relative to its corresponding leg 60, 70, and 80, respectively. Legs or supports 60, 70, and 80 have ends 66, 76, and 86, respectively, that are coupled to the component 50. In this component, ends 66 and 76 are fixedly coupled to component 50 and end 86 is pivotally coupled to component 50.

Referring to FIG. 4, the third leg 80 is pivotally movable between a first position P1' (shown in phantom and shaded) and a second position P2' (shown in phantom) relative to the entertainment component 50. The surface engaging portion 82 is engageable with the support surface S and movable toward and away from the surface engaging portions 62 and 72 along the direction of arrow "B." As a result, movement of portion 82 changes the orientation of component 50 relative to the support surface S and the angle 13 between leg 70 and the support surface S varies.

The component 50 is disposed at a first angular orientation O1' (shown in phantom and shaded) relative to the support surface S when the third leg 80 is in its first position P1' and at a second angular orientation O2' (shown in phantom) relative to the support surface S when the third leg 80 is in its second position P2'. The second angular orientation O2' is different than the first angular orientation O1' as shown.

The entertainment component 50 is disposed at an orientation Ox' intermediate orientations O1' and O2' when leg 80 is in a position Px' intermediate positions P1' and P2'. Thus, the angular orientation of component 50 relative to the support surface S may be selected by moving the surface engaging portion 82 toward or away from the surface engaging portions 62 and 72.

Figure 5:
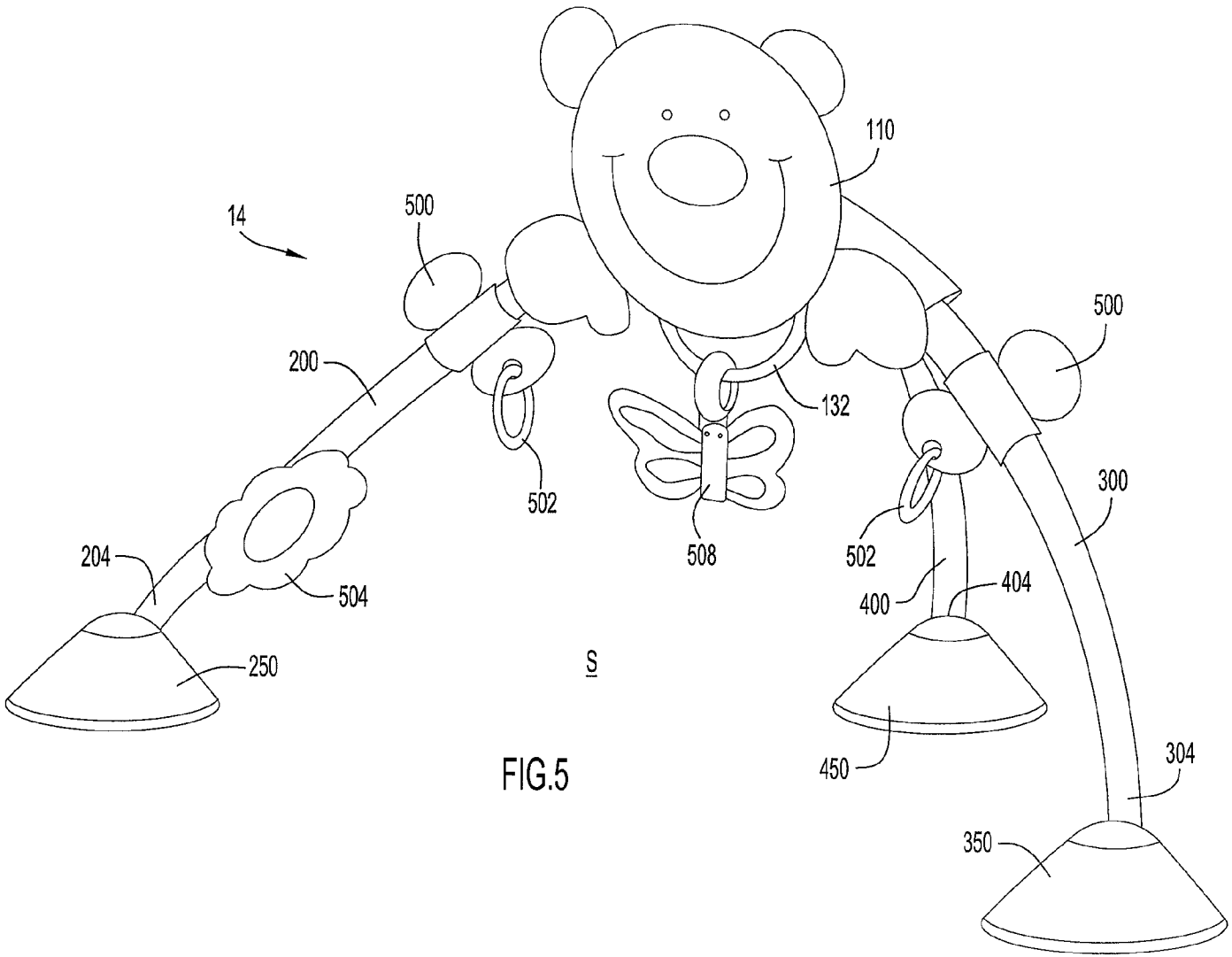
FIG. 5 illustrates a perspective view of an alternative embodiment of an infant entertainment device in a first orientation.
Figure 6:
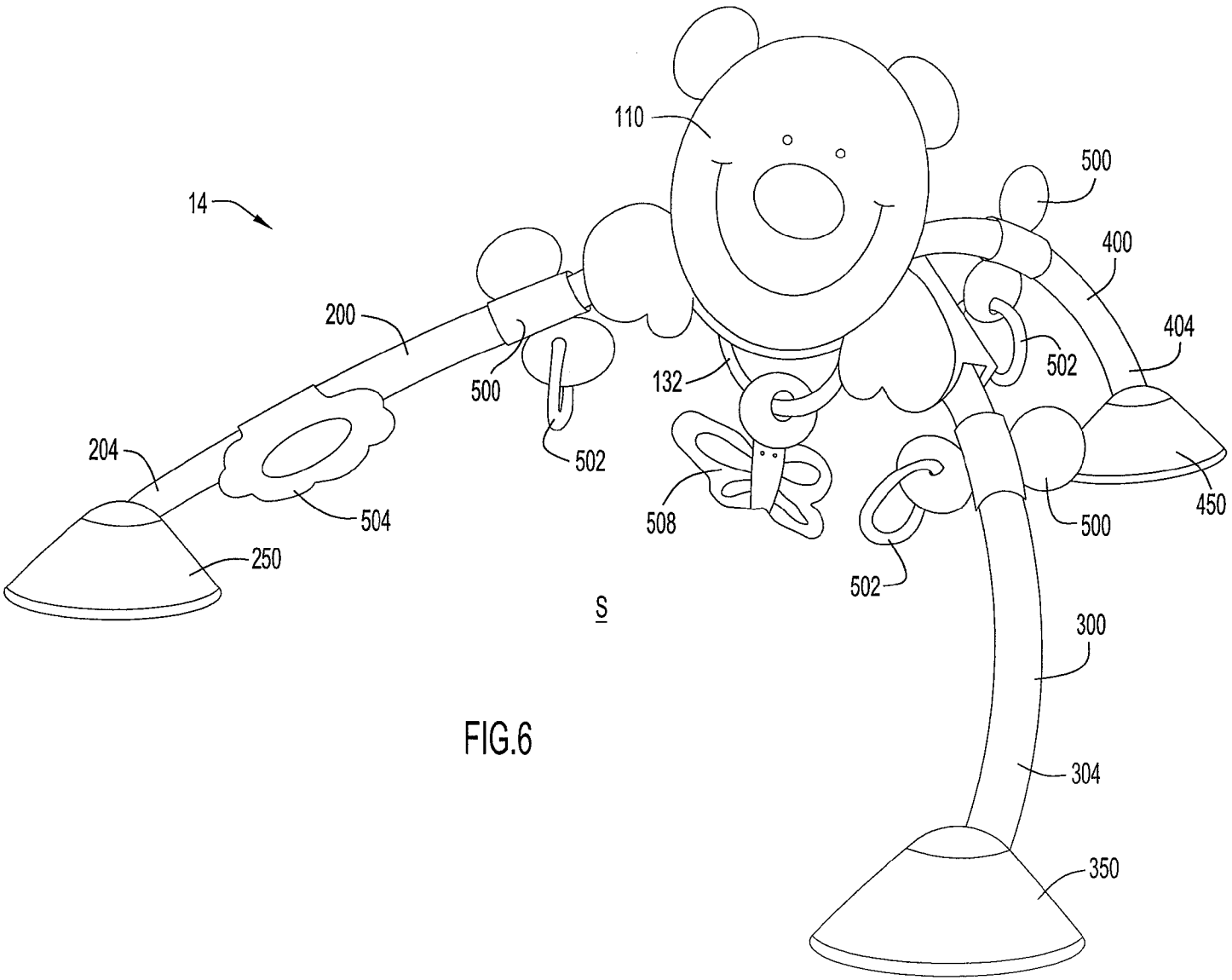
FIG. 6 illustrates a perspective view of the infant entertainment device illustrated in FIG. 5 showing the device in a second orientation.
Figure 7:
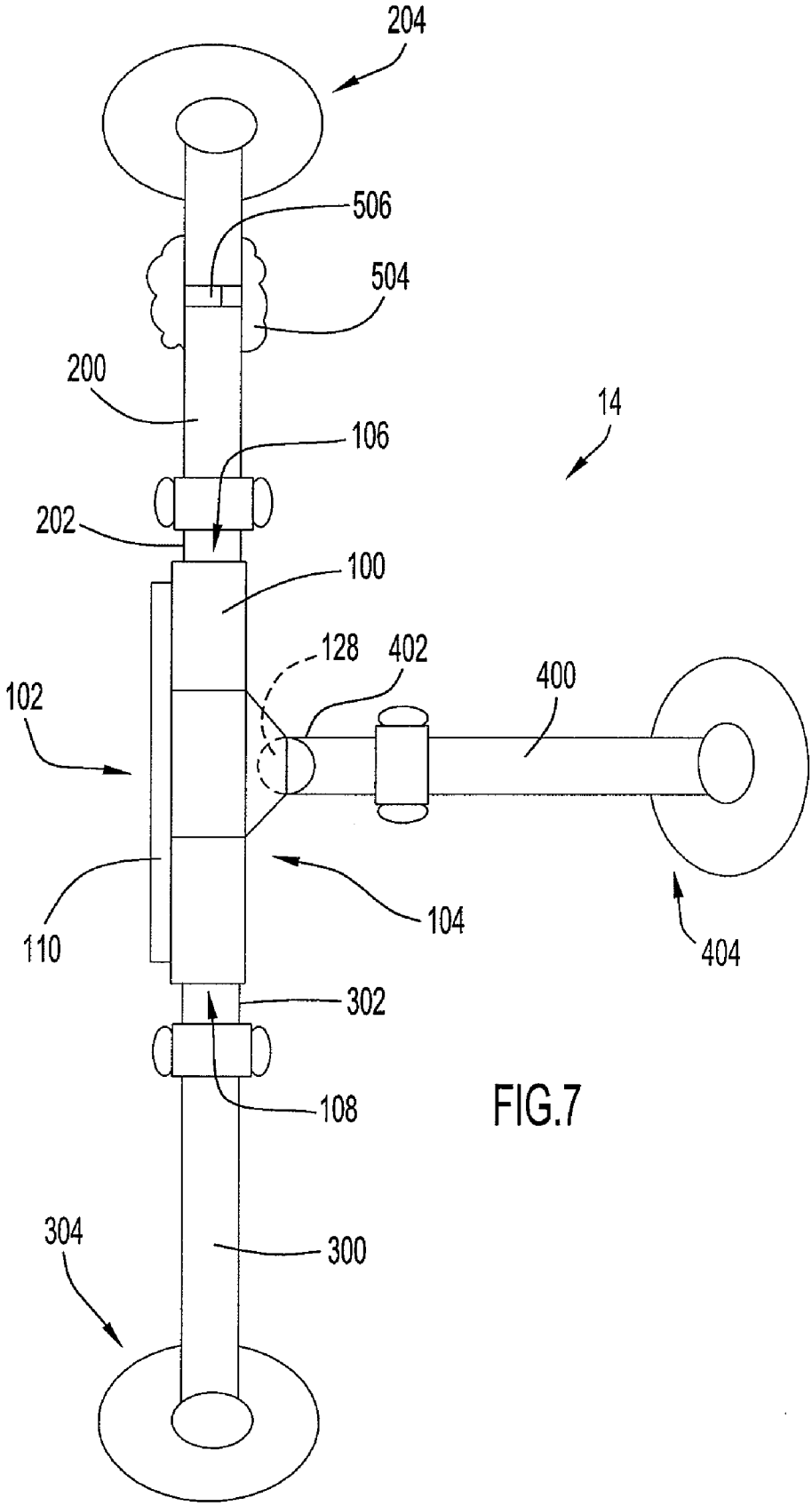
FIG. 7 illustrates a plan view of the infant entertainment device illustrated in FIG. 5.

Referring to FIGS. 5-8, an alternative embodiment of an infant entertainment device 14 is illustrated. In this embodiment, as shown in FIG. 7, infant entertainment device 14 includes a hub 100 including a front portion 102 and an opposing rear portion 104, and a first side 106 and an opposing second side 108. The front portion 102 includes an entertainment component 110. An exemplary configuration of the entertainment component 110 is illustrated as a bear face and paws. However, such a configuration is exemplary only and in different embodiments, the component 110 may or may not include an electronic system.

A first leg 200 extends outwardly from the first side 106 of the hub 100. The first leg 200 which includes a first end 202 fixedly coupled to the hub 100 and an opposite second end 204 engageable with a support surface S. A second leg 300 extends outwardly from the second side 108 of the hub 100. The second leg 300 has a first end 302 fixedly coupled to the hub 100 and an opposite second end 304 engageable with the support surface S. A third leg 400 extends outwardly from the rear portion 104 of the hub 100. In this embodiment, the third leg 400 is substantially perpendicular to the legs 200 and 300. The third leg 400 has a first end 402 pivotally coupled to the hub 100 and an opposite second end 404 engageable with the support surface S.

Figure 8:
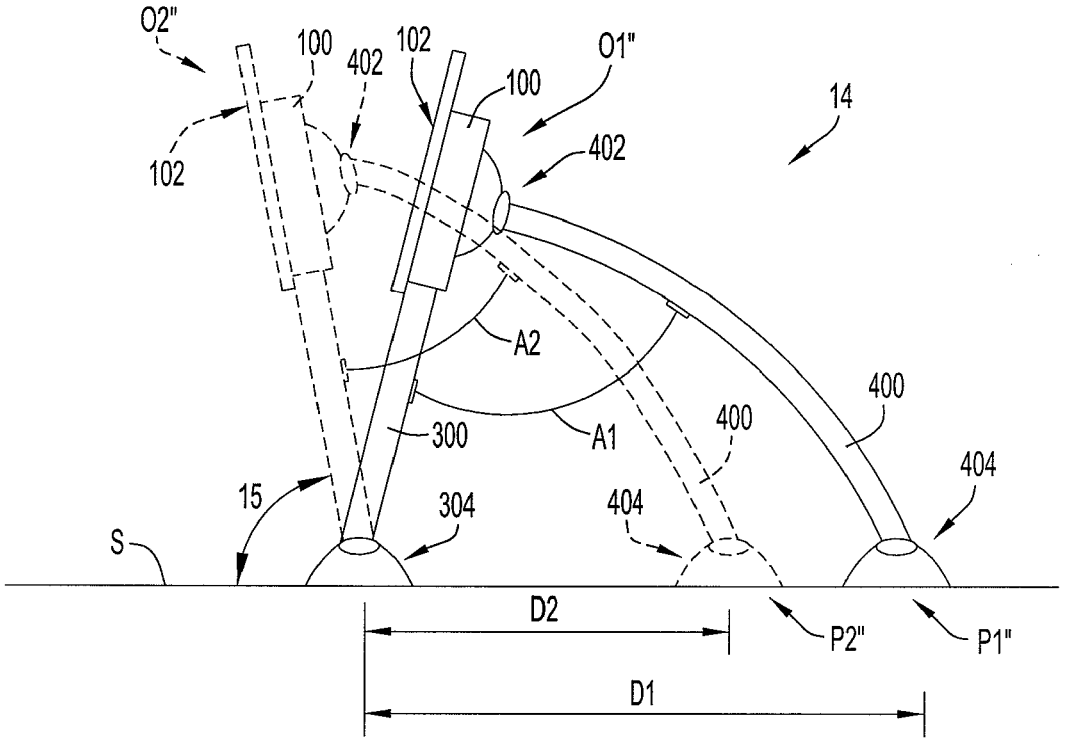
FIG. 8 illustrates a side view of the infant entertainment device illustrated in FIG. 5 in different configurations.

Referring to FIG. 8, the second end 404 of the third leg 400 is movable along the direction of arrow "C" toward and away from ends 204 and 304 of legs 200 and 300, respectively, and from the hub 100 upon movement of end 402 of the leg 400 relative to the hub 100. This movement results in a change in the orientation of the hub 100 and the entertainment component 110. In addition, the overall configuration of the infant entertainment device 14 changes and the angle 15 between the device 14 and the support surface S changes.

The front portion 102 of the hub 100 is disposed at a first orientation O1" relative to the support surface S when the third leg 400 is in a first position P1". The front portion 102 of the hub 100 is disposed at a second orientation O2" relative to the support surface S when the third leg 400 is in a second position P2" different from the first position P1".

In the first orientation O1" and the first position P1", the second leg 300 (or first leg 200) and the third leg 400 define a first angle A1, and the second end 304 of the second leg 300 (or second end 204 of the first leg 200) and the second end 404 of the third leg 400 are spaced by a first distance D1. In the second orientation O2" and the second position P2", the second leg 300 (or first leg 200) and the third leg 400 subtend a second angle A2, and the second end 304 of the second leg 300 (or second end 204 of the first leg 200) and the second end 404 of the third leg 400 are spaced by a second distance D2.

The first angle A1 is greater than the second angle A2, and the first distance D1 is greater than the second distance D2. When the angle is greater (A1 vs. A2), then the angle 15 at which the hub 100 is oriented relative to the support surface S is greater. The larger that angle 15 is results in the hub 100 being positioned so that it is inclined upward and positioned more for a standing infant. When the angle is smaller (A2 vs. A1), then the angle 15 at which the hub 100 is oriented is smaller. The smaller that angle 15 is results in the hub 100 being positioned downwardly so that it faces or is oriented toward an infant that is sitting or laying down.

Figure 9:
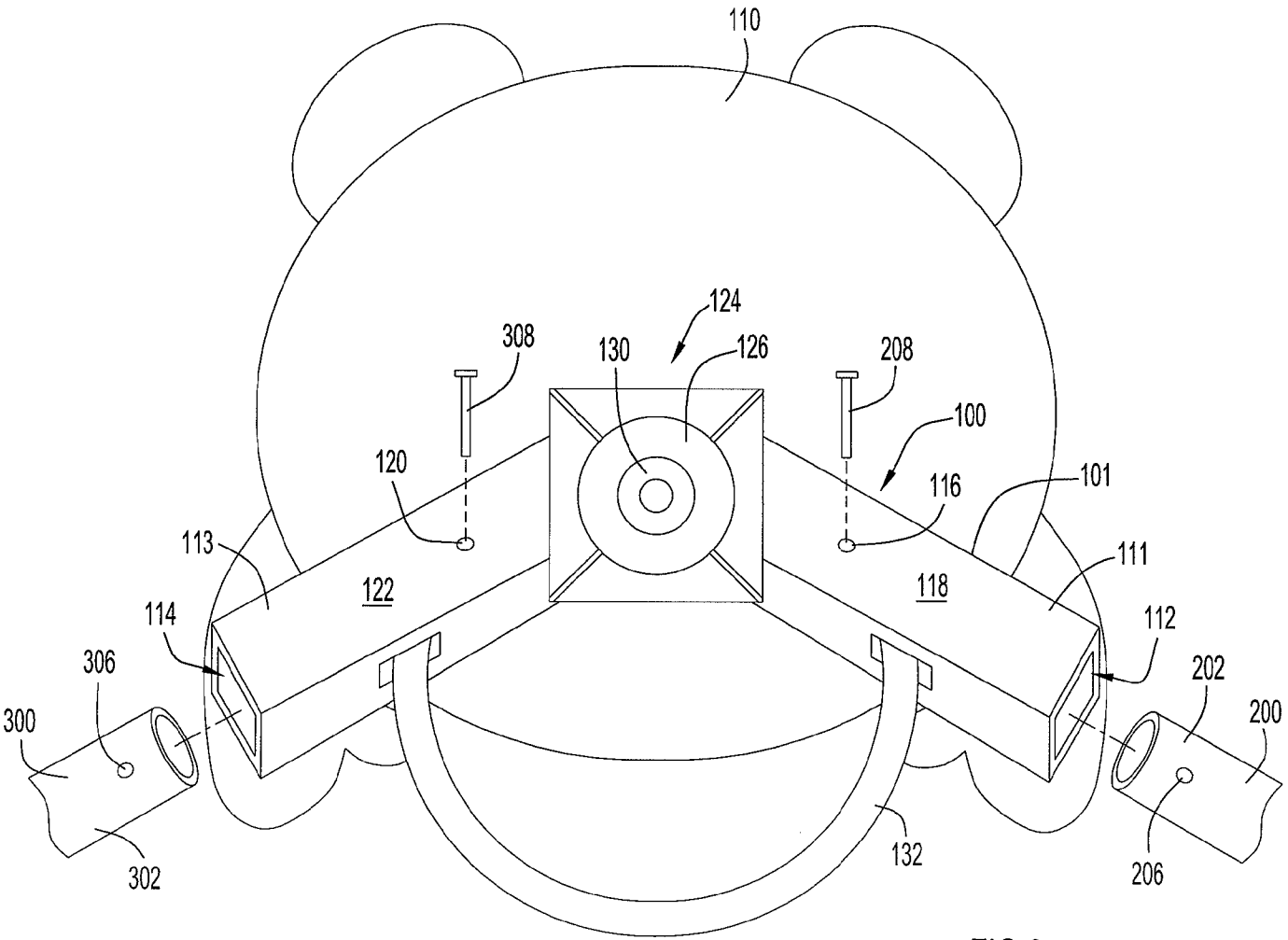
FIG. 9 illustrates rear perspective assembly view of some components of the infant entertainment device illustrated in FIG. 5.

Referring to FIG. 9, the hub 100 includes a mounting structure 101 that has several components as shown. In this embodiment, the mounting structure includes a mount 111 defining a bore 112 and a mount 113 defining a bore 114. Bore 112 is configured to receive end 202 of leg 200 and bore 114 is configured to receive end 302 of leg 300.

The mount 111 includes an opening 116 extending through a wall portion 118 of the mount 111, and mount 113 includes an opening 120 extending through a wall portion 122 of the mount 113. Each of the ends 202 and 302 of legs 200 and 300 includes an opening 206 and 306, respectively, formed therein. End 202 is insertable into bore 112 so that opening 116 is aligned with opening 206 in leg 200. A pin 208 is inserted through the aligned openings 116 and 206, thereby securing leg 200 to the hub 100. Similarly, end 302 of leg 300 is insertable into bore 114 so that the opening 120 is aligned with the opening 306 in leg 300. Another pin 308 is inserted through the aligned openings 120 and 306, thereby securing the leg 300 to the hub 100.

In other embodiments, other mechanisms may be used to secure the legs 200 and 300 to the hub 100. Further, the illustrated configurations of legs 200 and 300 and the hub 100 are exemplary. For example, ends 202 and 302 may include swaged or tapered ends that are connected to a corresponding attachment portion of the hub 100, such as by bolts, screws, adhesive, etc. Further, ends 202 and 302 of the legs 200 and 300 may have identical configurations (as shown), or alternatively different configurations. For example, end 202 of leg 200 may have a generally square configuration, which is received in a correspondingly configured square-shaped bore in the hub 100, while end 302 of leg 300 may have a generally oval configuration, which is received in a correspondingly configured oval-shaped bore in the hub 100. The different configurations of the ends 202 and 302 could thus include keyed configurations to ensure proper assembly.

Referring to FIG. 9, the hub 100 also includes a connection portion 124 between the bores 112 and 114. End 402 of leg 400 is pivotally coupled to the connection portion 124. The connection portion 124 may include a housing 126 defining a cavity 128 (shown in phantom in FIG. 7). A ball member 130 is pivotally disposed within the cavity 128 to form a ball-and-socket joint. The first end 402 of the third leg 400 is connected to the ball member 130, and thus is pivotal relative to the entertainment component 110.

It should be understood that the ball-and-socket configuration of the connection portion 124 is exemplary. Alternatively, end 402 may be hingedly connected to the rear portion 104 of the hub 100, or hingedly connected to the entertainment component 110. However, the connection mechanism should permit pivotal movement of leg 400 relative to the entertainment component 110 (as shown in FIG. 8).

Referring again to FIGS. 5 and 6, one or more of the legs 200, 300 and/or 400 may have a substantially arcuate configuration. It should be understood, however, that such a configuration is exemplary only. For example, legs 200, 300 and/or 400 may alternatively have a substantially linear configuration, or include two or more linear sections angularly disposed relative to each other.

In addition, one or more of the legs 200, 300 and/or 400 may include supplemental entertainment elements. For example, each of the legs 200, 300, 400 may include a supplemental entertainment element 500 including an engagement ring 502. Additional toys (not shown) may be releasably attached to the engagement ring(s) 502. Alternatively or in addition, additional entertainment elements may be attached to one or more of the legs 200, 300, and 400. As shown, an exemplary flower toy 504 is releasably attached to first leg 200, such as by a hook and loop fastener mechanism 506 (shown in FIG. 7).

Further, the hub 100 may include an engagement element 132 for attaching other entertainment elements. As best shown in FIG. 9, engagement element 132 is configured as an arcuate member connected to the hub 100 and extending downwardly relative to the entertainment component 110. In one embodiment, an exemplary butterfly toy 508, shown in FIGS. 5 and 6, is attached to the engagement element 132, and is slidably and rotatably disposed thereon. Thus, it should be understood that various other entertainment elements may thus be fixedly or releasably attached to legs 200, 300 and/or 400, and/or to the hub 100 as desired.

Referring to FIGS. 5 and 6, leg 200 includes a support member 250 pivotally coupled to end 204 of leg 200. Similarly, leg 300 includes a support member 350 pivotally coupled to end 304 of leg 300. Leg 400 also includes a support member 450 pivotally coupled to end 404 of leg 400. The pivoting connection between support members 250, 350, and 450 and the corresponding legs 200, 300, and 400 facilitates the reconfiguring of the infant entertainment device 14.

Figure 10:
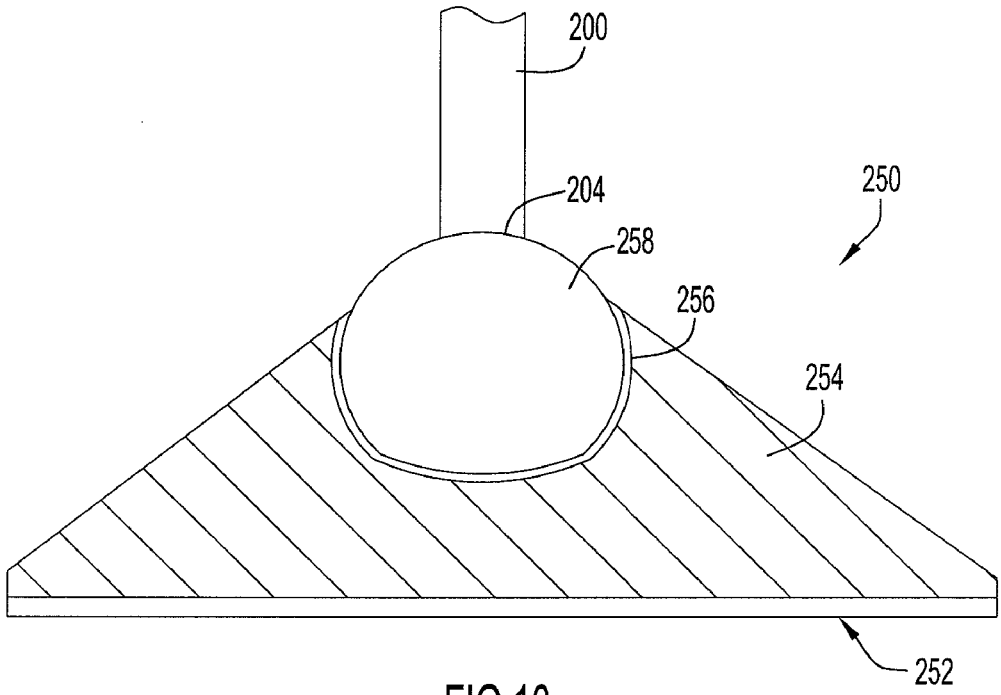
FIG. 10 illustrates a cross-sectional view of an embodiment of a support member of the infant entertainment device illustrated in FIG. 5.

Referring to FIG. 10, the support member 250 includes a surface engaging portion 252 that is adjustably disposed relatively to the orientation of leg 200 due to the pivotal coupling between leg 200 and the support member 250. In one embodiment, the support member 250 includes a housing 254 defining a cavity 256. A ball member 258 is pivotally disposed within the cavity 256 to form a ball-and-socket joint. The second end 204 of leg 200 is connected to the ball member 258, and thus is pivotal relative to the surface engaging portion 252. The support member 350 of leg 300 and/or the support member 450 of leg 400 may have a configuration identical to the configuration of the support member 250.

Figure 11:
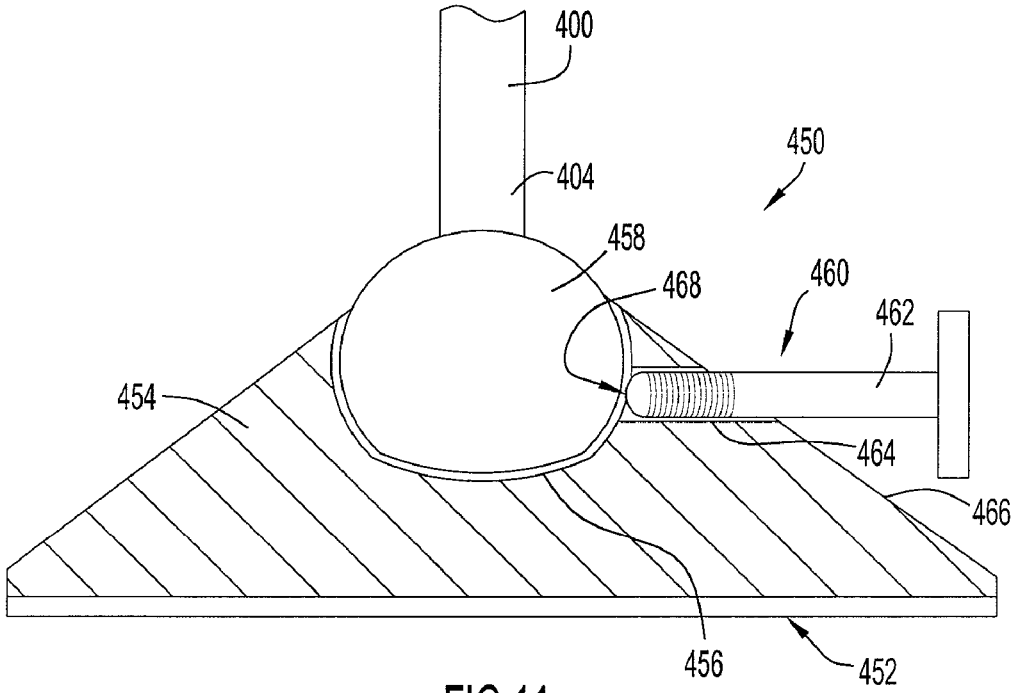
FIG. 11 illustrates a cross-sectional view of another embodiment of a support member of the infant entertainment device illustrated in FIG. 5.

Referring to FIG. 11, in one embodiment, the support member 450 of leg 400 includes a surface engaging portion 452, and a housing 454 defining a cavity 456 in which a ball member 458 is pivotally disposed to form a ball-and-socket joint, as described above. However, the support member 450 also includes a lock mechanism 460 configured for releasably retaining the ball member 458 and thus leg 400 in a selected position.

Referring to FIG. 11, a lock mechanism 460 according to another embodiment is illustrated. In this embodiment, the lock mechanism 460 includes a threaded member 462 disposed within a correspondingly threaded bore 464 extending into a sidewall 466 of the housing 454. The bore 464 extends into the cavity 456. A distal end 468 of the threaded member 462 is movable toward the ball member 458 disposed within the cavity 456 as the threaded member 462 is screwed into the bore 464, until the distal end 468 frictionally engages the ball member 458 and releasably locks the ball member 458 in a selected position within the cavity 456.

Leg 400 is thereby releasably locked in the selected position provided that pivotal movement of the ball member 458 within the cavity 456, to which the second end 404 is connected, has stopped. In order to readjust the selected position, the distal end 468 of the threaded member 462 is moved away from the ball member 458 by unscrewing the threaded member 462 out of the bore 462. When the distal end 468 no longer engages the ball member 458, the ball member 458 is thereby unlocked from the selected position so that pivotal movement of the ball member 458 within the cavity 456 is once again permitted.

It should be understood that the lock mechanism 460 described above and illustrated in FIG. 11 is exemplary only. In other embodiments, different mechanisms can be used to releasably retain connecting members in a selected position relative to the support member 450 so that leg 400 is releasably retained in a selected position relative to the hub 100 when the support members 250, 350, and 450 are engaging the support surface S. Alternatively, the lock mechanism may be coupled to end 402 of leg 400 and/or to the connection portion 124, which may also include a similar ball-and-socket connecting joint as described above.

In one embodiment, the lock mechanism 460 releasably retains leg 400 in at least the first position P1" (or P1 or P1') and the second position P2" (or P2 or P2'). The lock mechanism 460 may releasably retain leg 400 in one or more additional positions, such as position Px shown in FIG. 2 or position Px' shown in FIG. 4, between the first position P1" (or P1 or P1') and the second position P2"(or P2 or P2').

Figure 12:
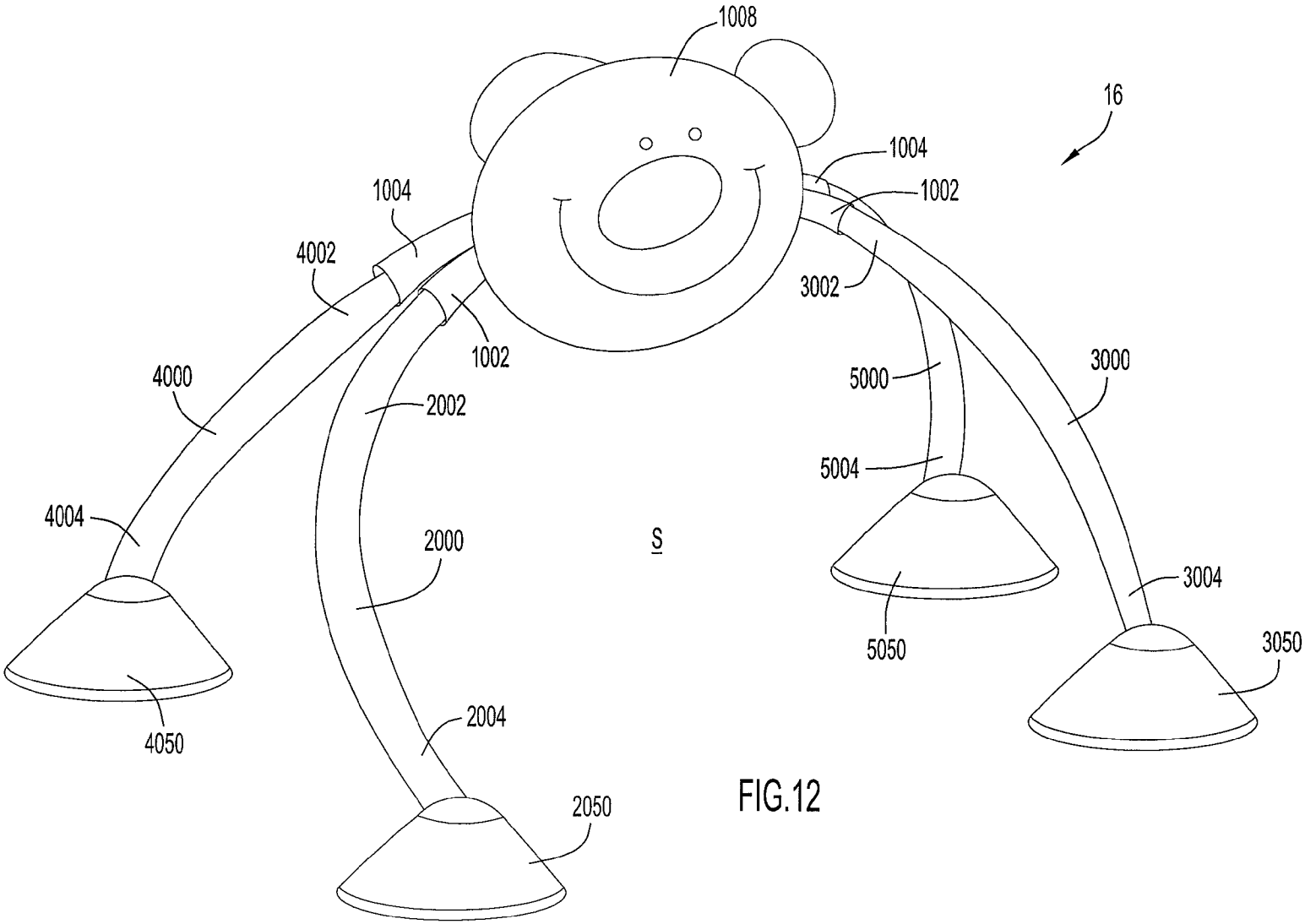
FIG. 12 illustrates a perspective view of another embodiment of an infant entertainment device.
Figure 13:
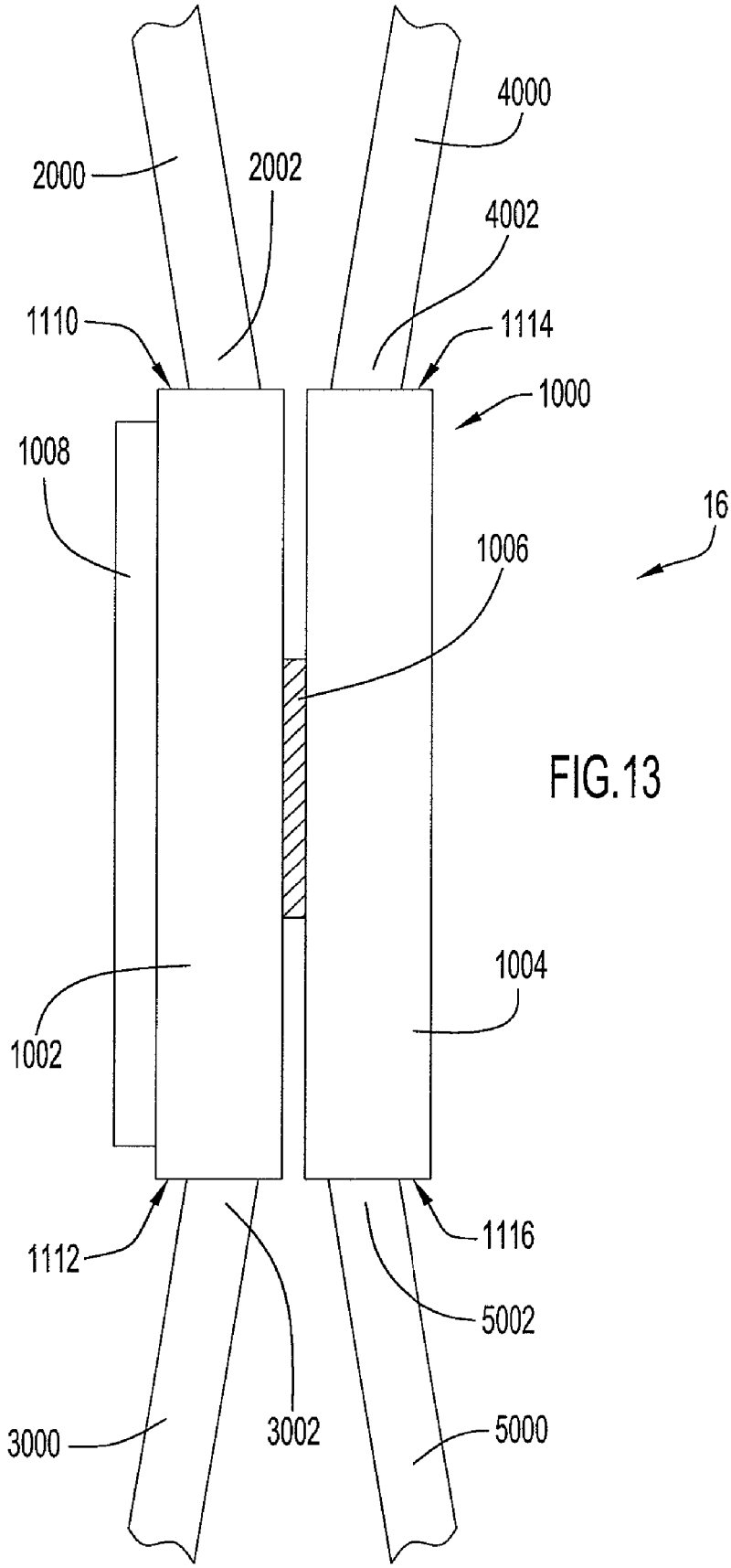
FIG. 13 illustrates a partial plan view of the infant gym entertainment device illustrated in FIG. 12.

Referring to FIGS. 12 and 13, an alternative embodiment of an infant entertainment device 16 is illustrated. In this embodiment, infant entertainment device 16 includes a hub 1000 with a first hub section 1002 and a second hub section 1004 hingedly connected to the first hub section 1002 via a connection member 1006. In one embodiment, the connection member 1006 is a hinge-like structure that can be coupled to both hub sections 1002 and 1004. The connection member 1006 enables the hub sections 1002 and 1004 to move relative to each other. An entertainment component 1008 is coupled to the first hub section 1002.

A first leg 2000 extends outwardly from a first side 1110 of the first hub section 1002, which includes a first end 2002 fixedly coupled to the first hub section 1002 and an opposite second end 2004 engageable with the support surface S. A second leg 3000 extends outwardly from a second side 1112 of the first hub section 1002, which likewise includes a first end 3002 fixedly coupled to the first hub section 1002 and an opposite second end 3004 engageable with the support surface S.

A third leg 4000 extends outwardly from a first side 1114 of the second hub section 1004, which includes a first end 4002 fixedly coupled to the second hub section 1004 and an opposite second end 4004 engageable with the support surface S. A fourth leg 5000 extends outwardly from a second side 1116 of the second hub section 1004, which includes a first end 5002 fixedly coupled to the second hub section 1004 and an opposite second end 5004 engageable with the support surface S.

The first leg 2000 includes a support member 2050 pivotally coupled to the second end 2004 thereof. Similarly, the second leg 3000 includes a support member 3050 coupled to the second end 3004 thereof, the third leg 4000 may include a support member 4050 pivotally coupled to the second end 4004 thereof, and the fourth leg 5000 may include a support member 5050 pivotally coupled to the second end 5004 thereof. Each of the support members 2050, 3050, 4050 and 5050 may have a configuration identical to that shown in FIG. 10 and described above. Alternatively, one or more of the support members 2050, 3050, 4050 and/or 5050 may including a lock mechanism as shown in FIG. 11 and described above. In this embodiment, to reconfigure the device 16 and change the orientation of component 1008, a user moves the rear legs 4000 and 5000 away from front legs 2000 and 3000 about pivot join 1006.

Figure 14:
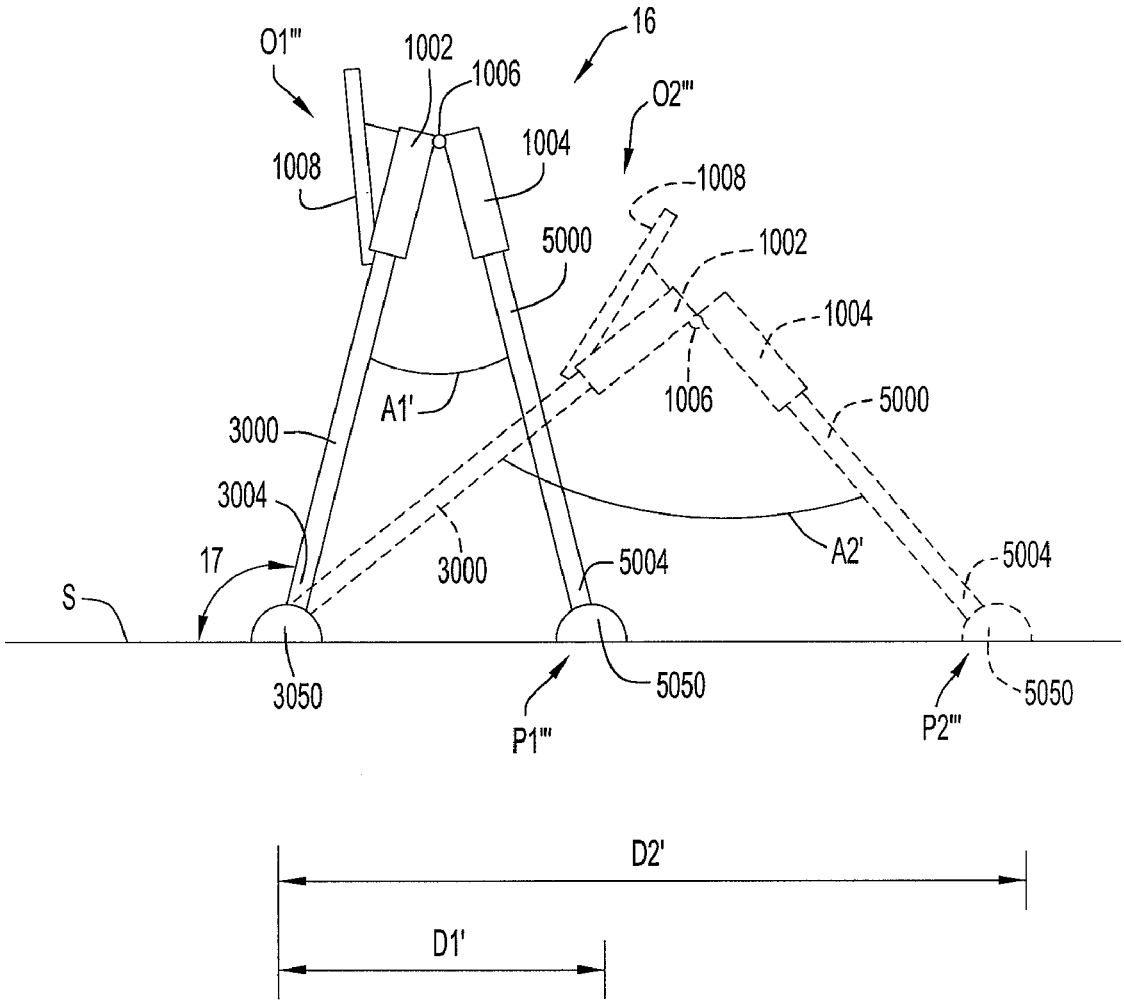
FIG. 14 illustrates a side view of the infant entertainment device illustrated in FIG. 12 in different configurations.

Referring to FIG. 14, the second ends 4004, 5004 of the third and fourth legs 4000, 5000 are movable toward and away from the second ends 2004, 3004 of the first and second legs 2000, 3000 upon pivotal movement of the first hub section 1002 relative to the second hub section 1004. The movement results in a change in the orientation of the entertainment component 1008 and the angle 17 between the support surface S and the legs 2000 and 3000. The entertainment component 1008 is disposed at a first orientation O1'" relative to the support surface S in which it is more upright when the third and fourth legs 4000, 5000 are in a first position P1'". The entertainment component 1008 is disposed at a second orientation O2'" relative to the support surface S in which it is more reclined when the third and fourth legs 4000, 5000 are in a second position P2'" different from the first position P1'".

In the first orientation O1'" and the first position P1'", the first and second legs 2000, 3000 and the third and fourth legs 4000, 5000 define a first angle A1', and the second ends 3004, 4004 of the first and second legs 2000, 3000 and the second ends 4004, 5004 of the third and fourth legs 4000, 5000 are spaced by a first distance D1'. In the second orientation O2'" and the second position P2'", the first and second legs 2000, 3000 and the third and fourth legs 4000, 5000 define a second angle A2', and the second ends 2004, 3004 of the first had second legs 2000, 3000 and the second ends 4004, 5004 of the third and fourth legs 4000, 5000 are spaced by a second distance D2'. The first angle A1' is less than the second angle A2', and the first distance D1' is less than the second distance D2'.

Each of the first ends 2002, 3002, 4002, 5002 of the legs 2000, 3000, 4000, 5000 may be secured within correspondingly configured bores disposed in the first and second hub sections 1002, 1004, similar to the bore configuration shown in FIG. 9 and as described above. However, various other mechanisms may be employed for securing the legs 2000, 3000, 4000, 5000 to the first and second hub sections 1002, 1004, as would be readily understood by one skilled in the art.

Referring again to FIG. 12, one or more of the legs 2000, 3000, 4000 and/or 5000 may have a substantially arcuate configuration. It should be understood, however, that such a configuration is exemplary only. For example, legs 2000, 3000, 4000 and/or 5000 may alternatively have a substantially linear configuration, or include two or more linear sections angularly disposed relative to each other. In addition, one or more of the legs 2000, 3000, 4000 and/or 5000 may include supplemental entertainment elements, as described above.

Thus, the adjustability of one or more legs of an infant entertainment device according to the invention allows a user to reconfigure the device and change the orientation of a component of the device relative to support surface to accommodate different infants and infants in different positions.

In different embodiments, the various components of the infant entertainment device can be made from plastic, metal, or any other appropriate materials.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. An infant gym, comprising:

a hub including opposing front and rear portions and opposing first and second sides, the front portion including an entertainment component;

a first leg extending outwardly from the first side, the first leg having a first end fixedly coupled to the hub and an opposite second end engageable with a support surface;

a second leg extending outwardly from the second side, the second leg having a first end fixedly coupled to the hub and an opposite second end engageable with the support surface; and a third leg extending outwardly from the rear portion, the third leg having a first end pivotally coupled to the hub and an opposite second end engageable with the support surface, the second end of the third leg being movable toward and away from the hub upon movement of the first end of the third leg relative to the hub, such movement resulting in a change in the orientation of the entertainment component, wherein the front portion of the hub is disposed at a first orientation relative to the support surface when the third leg is in a first position and a second orientation relative to the support surface when the third leg is in a second position different from the first position.

2. The infant gym of claim 1, further comprising a lock mechanism coupled to the third leg, the lock mechanism releasably retaining the third leg in at least the first position and the second position.

3. The infant gym of claim 1, wherein the third leg is substantially perpendicular to the first and second legs.

4. The infant gym of claim 1, wherein each of the legs has a substantially arcuate configuration.

5. The infant gym of claim 1, wherein each of the legs includes a support member pivotally coupled to the second end of the leg.

6. The infant gym of claim 1, wherein the second end of each of the legs includes a pivotally coupled surface engaging portion coupled thereto, each surface engaging portion being adjustable relative to its corresponding leg.

7. The infant gym of claim 1, further comprising a supplemental entertainment element coupled to a corresponding one of the legs intermediate the first and second ends thereof.

8. An infant gym, comprising:

a first support member having first and second opposite ends, each of the ends being engageable with a support surface, the first support member including a hub located between the ends, the hub including a front portion and an opposing rear portion; and a second support member having a first end and an opposite second end, the first end of the second support member being pivotally coupled to the rear portion of the hub, the second end of the second support member engageable with the support surface and movable toward and away from the ends of the first support member, thereby changing the orientation of the first support member relative to the support surface, wherein the front portion of the hub is disposed at a first orientation relative to the support surface when the second support member is in a first position, and the front portion of the hub is disposed at a second orientation relative to the support surface when the second support member is in a second position different from the first position.

9. The infant gym of claim 8, wherein the second support member is substantially perpendicular to the first support member.

10. The infant gym of claim 8, wherein the first support member has a U-shaped configuration.

11. The infant gym of claim 8, further comprising a lock mechanism coupled to the second support member, the lock mechanism releasably retaining the second support member in a selected orientation relative to the support surface.

12. The infant gym of claim 8, wherein the hub is fixedly connected to the first support member.

13. The infant gym of claim 8, wherein each of the ends of the first support member includes a pivotally coupled surface engaging portion coupled thereto.

14. An infant entertainment device, comprising:

an entertainment component including a first side and a second side opposite to the first side;

a first leg extending outwardly from the first side of the entertainment component;

a second leg extending outwardly from the second side of the entertainment component; and a third leg extending outwardly from the entertainment component, the third leg being pivotally movable between a first position and a second position relative to the entertainment component, the entertainment component being disposed at a first angular orientation relative to a support surface when the third leg is in its first position and at a second angular orientation relative to the support surface when the third leg is in its second position, the second angular orientation being different than the first angular orientation.

15. The infant entertainment device of claim 14, wherein each of the legs has a substantially arcuate configuration.

16. The infant entertainment device of claim 14, wherein each of the legs includes a pivotally coupled surface engaging portion coupled thereto, each surface engaging portion being adjustable relative to its corresponding leg.

17. The infant entertainment device of claim 14, further comprising a lock mechanism coupled to the third leg, the lock mechanism releasably retaining the third leg in a selected position between its first position and its second position.

18. The infant entertainment device of claim 14, wherein the entertainment component is fixedly connected to the first and second legs.

19. An infant gym, comprising:

a hub including opposing front and rear portions and opposing first and second sides, the front portion including an entertainment component;

a first leg extending outwardly from the first side, the first leg having a first end fixedly coupled to the hub and an opposite second end engageable with a support surface;

a second leg extending outwardly from the second side, the second leg having a first end fixedly coupled to the hub and an opposite second end engageable with the support surface; and a third leg extending outwardly from the rear portion, the third leg having a first end pivotally coupled to the hub and an opposite second end engageable with the support surface, the second end of the third leg being movable toward and away from the hub upon movement of the first end of the third leg relative to the hub, such movement resulting in a change in the orientation of the entertainment component, wherein the third leg is substantially perpendicular to the first and second legs.

20. An infant gym comprising:

a first support member having first and second opposite ends, each of the ends being engageable with a support surface, the first support member including a hub located between the ends, the hub including a front portion and an opposing rear portion; and a second support member having a first end and an opposite second end, the first end of the second support member being pivotally coupled to the rear portion of the hub, the second end of the second support member engageable with the support surface and movable toward and away from the ends of the first support member, thereby changing the orientation of the first support member relative to the support surface, wherein the second support member is substantially perpendicular to the first support member.

* * * * *